US007109937B2

(12) United States Patent
Iluz et al.

(10) Patent No.: US 7,109,937 B2
(45) Date of Patent: Sep. 19, 2006

(54) PHASED ARRAY PLANAR ANTENNA AND A METHOD THEREOF

(75) Inventors: Zeev Iluz, Gan-Yavne (IL); Claude Samson, Rehovot (IL); Amnon Gafni, Rehovot (IL)

(73) Assignee: Elta Systems Ltd., Ashdod (IL)

( * ) Notice: Subject to any disclaimer, the term of this patent is extended or adjusted under 35 U.S.C. 154(b) by 30 days.

(21) Appl. No.: 10/998,155

(22) Filed: Nov. 29, 2004

(65) Prior Publication Data

US 2006/0114164 A1 Jun. 1, 2006

(51) Int. Cl.
*H01Q 3/00* (2006.01)
*H01Q 1/28* (2006.01)

(52) U.S. Cl. ..... 343/757; 343/756; 343/758; 343/765

(58) Field of Classification Search ..... 343/756, 343/757, 758, 765, 711, 713
See application file for complete search history.

(56) References Cited

U.S. PATENT DOCUMENTS

| | | | | |
|---|---|---|---|---|
| 3,953,857 | A | 4/1976 | Jenks | |
| 4,827,269 | A | 5/1989 | Shestag et al. | |
| 5,359,337 | A * | 10/1994 | Eguchi | 343/765 |
| 5,796,370 | A | 8/1998 | Courtonne et al. | |
| 6,034,634 | A | 3/2000 | Karlsson et al. | |
| 6,034,643 | A | 3/2000 | Nishikawa et al. | |
| 6,218,999 | B1 | 4/2001 | Bousquet et al. | |
| 6,356,239 | B1 | 3/2002 | Carson | |
| 6,400,315 | B1 | 6/2002 | Adler et al. | |
| 6,466,179 | B1 | 10/2002 | Ehrenberg et al. | |
| 6,466,181 | B1 * | 10/2002 | Ho et al. | 343/882 |
| 6,710,749 | B1 * | 3/2004 | King | 343/757 |
| 6,741,841 | B1 | 5/2004 | Mitchell | |
| 6,751,801 | B1 | 6/2004 | Frisco et al. | |
| 6,999,036 | B1 * | 2/2006 | Stoyanov et al. | 343/765 |
| 7,015,866 | B1 * | 3/2006 | Lopez | 343/757 |
| 2001/0046258 | A1 | 11/2001 | Wise et al. | |

FOREIGN PATENT DOCUMENTS

WO WO 2004/075339 A2 9/2004

* cited by examiner

*Primary Examiner*—Trinh Vo Dinh
(74) *Attorney, Agent, or Firm*—Browdy and Neimark, PLLC

(57) ABSTRACT

A phased array antenna system accommodating onto a platform for tracking a target moving relatively to the platform, the antenna system comprising a first planar active subsystem operable for receiving/transmitting an RF signal of a certain linear polarization direction and for selectively performing electronic scanning; a second, roll subsystem coupled to the active subsystem and operable for rotational movement of the active subsystem about a first axis perpendicular to a plane defined by the planar active subsystem; a third, elevation subsystem coupled to the second, roll subsystem and to a fourth azimuth subsystem, the azimuth subsystem defining a central axis of the antenna system and being operable for providing rotational movement of the first planar subsystem about the central axis, the elevation subsystem being configured to provide a certain angular orientation between the plane defined by the active subsystem and a plane defined by the azimuth subsystem, thereby allowing positioning the first planar active subsystem with respect to the target such that the linear polarization direction is substantially aligned with a linear polarization direction of RF radiation received and/or transmitted by the target.

18 Claims, 7 Drawing Sheets

PHASED ARRAY PLANAR ANTENNA AND A METHOD THEREOF

FIELD OF THE INVENTION

This invention relates to phased array antennas and planar antennas and more specifically to phased array antennas of the kind suitable to be mounted onto moving platforms e.g. aircrafts, ships, cars etc., used for satellite communication, or for tracking moving targets.

BACKGROUND OF THE INVENTION

Nowadays, many moving platforms (e.g. aircrafts, ships, cars, etc.) are required to have satellite communication capabilities. One exemplary requirement relates to an entertainment system for offering passengers with e.g. internet access, live television broadcast and the like.

During motion, the moving platform (e.g. the aircraft) is engaged in communication with a particular satellite, tracking it across the sky until it disappears over the horizon, and prior to its disappearance establishes communication with another satellite. Therefore, antennas on-board the moving platforms are typically equipped with suitable positioning and tracking systems.

U.S. Pat. No. 5,796,370 discloses a dual polarization antenna for direct broadcast satellites. The antenna is orientable, directional and capable of use as a transmit and/or receive antenna. It includes at least one reflector, at least one source of electromagnetic radiation including means for exciting the source with two orthogonal linear polarizations and a mechanical system for positioning and holding the source and the reflector. The orientation of the antenna is made up of depointing and rotation about a preferred direction of propagation of the radiation and the mechanical system enables such rotation while keeping the source fixed, so conserving the orientation of the orthogonal linear polarization. A preferred embodiment of the antenna includes a parabolic main reflector and a hyperbolic auxiliary reflector in a Cassegrain geometry, and the mechanical system enables rotation of both reflectors about the preferred direction of radiation and holds the source fixed to conserve the orthogonal linear polarization axes of the beam. Applications include radar, direct broadcast satellites and telecommunications employing frequency re-use by polarization diversity, especially advantageous in space and airborne applications.

U.S. Pat. No. 6,034,634 discloses an inexpensive high gain antenna for use on terminals communicating with low earth orbit (LEO) satellites which include an elevation table mounted for accurate movement about a transverse axis on an azimuth turntable mounted for rotational movement about a central axis. A plurality of antenna elements forming a phased array antenna is mounted on the top of the elevation table and have a scan plane which is parallel to and extends through the transverse axis of the elevation table. The antenna may be both mechanically and electrically scanned and is used to perform handoffs from one LEO satellite to another by positioning the elevation table of the antenna with its bore sight in a direction intermediate the two satellites and with the scan plane of the antenna passing through both satellites. At the moment of handoff, the antenna beam is electronically scanned from one satellite to another without any loss in data communication during the process.

U.S. Pat. No. 6,034,643 discloses a directional beam antenna device that includes an antenna supporting member which is supported on a base in such a manner as to be rotatable about a first rotational axis; an antenna portion which is supported on the antenna supporting member in such a manner as to be rotatable about a second rotational axis which is perpendicular to an antenna aperture and is inclined at a first angle with respect to the first rotational axis, the direction of an antenna beam being inclined at a second angle with respect to the second rotational axis; a first driving unit for rotating the antenna supporting member about the first rotational axis with respect to the base; and a second driving unit for rotating the antenna portion about the second rotational axis with respect to the antenna supporting member. A directional beam controlling apparatus is provided with a controlling unit for controlling an elevation angle of the antenna beam to a target value by causing the second driving unit to rotate the antenna portion with respect to the antenna supporting member, and for controlling an azimuth angle of the antenna beam to a target value by causing the first driving unit to rotate the antenna supporting member with respect to the base.

PCT Application No. WO2004/075339 discloses a low profile receiving and/or transmitting antenna that includes an array of antenna elements that collect and focuses millimeter wave or other radiation. The antenna elements are physically configured so that radiation at a tuning wavelength impinging on the antenna at a particular angle of incidence is collected by the elements and focused in-phase. Two or more mechanical rotators may be disposed to alter the angle of incidence of incoming or outgoing radiation to match the particular angle of incidence.

Also relating to positioning of satellite communication antennas on-board moving platforms are U.S. Pat. Nos. 6,400,315, 6,218,999, 6,741,841, 6,356,239, and 6,751,801.

As is known, polarization of a linear polarized radio wave may be rotated as the signal passes through any anomalies (such as Faraday rotation) in the ionosphere. Furthermore, due to the position of the Earth with respect to the satellite, geometric differences may vary due to relative movements between the satellite and the communicating station (e.g. aircraft, fixed station. etc.). Therefore, most geostationary satellites operate with circular polarization, as circular polarization will keep the signal constant regardless of the above-mentioned anomalies. However, some geostationary satellites use linear polarization. In linear polarization, a misalignment of polarization of 45 degrees will degrade the signal up to 3 dB and if misaligned 90 degrees, the attenuation can be 20 dB or more. Furthermore, polarization purity is required by international regulation of satellite communication. Therefore, on-board antenna systems for communication with a satellite using linear polarization need to provide polarization tracking.

Furthermore, on-board antenna systems for moving platforms are required to be relatively small in size and low in profile (diameter and height) in order to adapt to the overall design and specifically the aerodynamic design of the moving platform. However, polarization tracking typically requires a considerable antenna size, for compensating for losses of signal strength involved in polarization tracking.

There is a need in the art for an improved antenna that provides positioning capabilities as well as polarization tracking capabilities. There is a further need in the art for an improved antenna suitable for use on board moving platforms and specifically airborne platforms and aircrafts, which is relatively small and has low profile (e.g. diameter of about 90 cm or less).

SUMMARY OF THE INVENTION

According to one embodiment, the present invention provides for a phased array antenna system accommodating onto a platform for tracking a target moving relatively to the platform, comprising:

a first planar active subsystem operable for receiving/transmitting an RF signal of a certain linear polarization direction and for selectively performing electronic scanning;

a second, roll subsystem coupled to said active subsystem and operable for rotational movement of said active subsystem about a first axis perpendicular to a plane defined by said planar active subsystem;

a third, elevation subsystem coupled to said second, roll subsystem and to a fourth azimuth subsystem, said azimuth subsystem defining a central axis of the antenna system and being operable for providing rotational movement of the first planar subsystem about the central axis, the elevation subsystem being configured to provide a certain angular orientation between said plane defined by said active subsystem and a plane defined by the azimuth subsystem, thereby allowing positioning said first planar active subsystem with respect to said target such that said linear polarization direction is substantially aligned with a linear polarization direction of RF radiation received and/or transmitted by the target. The term 'planar' is used hereinafter to denote a planar or a substantially planar active subsystem.

According to another embodiment, the above-mentioned first, second and fourth subsystems are coupled to a common control system configured to operate said first, second and fourth subsystems in synchronization. According to yet another embodiment, the common control subsystem comprising:

a Central Processing Unit (CPU);

a memory coupled to the CPU;

a data input module coupled to said CPU and connectable to data systems of said platform, for inputting data relating to the relative position of said platform with respect to said target; and a positioning and polarization tracking module coupled to the CPU and configured for operating said first, second and fourth subsystems.

According to another embodiment, the third, elevation subsystem being configured to provide a controllably changeable angular orientation between the plane defined by the active subsystem and a plane defined by the azimuth subsystem. According to yet another embodiment, the common control unit is further configured for controlling the operation of said third, elevation subsystem, thereby allowing selective adjustment of said scanning cone.

According to another embodiment, the present invention provides for a method for tracking at least one target with a phased array antenna system having a planar active subsystem and accommodating onto a platform moving relatively to the target, the method comprising:

(i) receiving/transmitting an RF signal of a certain linear polarization direction;

(ii) receiving and storing data regarding the position and polarization of the target and the antenna system, constituting position and polarization data;

(iii) in response to said position and polarization data, having the active subsystem selectively performing azimuth rotational movement about a central axis of the antenna system, roll rotational movement about a first axis perpendicular to a plane defined by the planar active subsystem, and electronic scanning;

thereby allowing positioning said planar active subsystem with respect to said target such that said linear polarization direction is aligned with a linear polarization direction of RF radiation received and/or transmitted by at least one moving target.

According to another embodiment, the present invention provides for a phased array antenna system accommodating onto a platform for tracking a target moving relatively to the platform comprising:

a first planar active subsystem operable for receiving/transmitting an RF signal of a certain linear polarization direction and for selectively performing electronic scanning;

a second, roll subsystem coupled to said active subsystem and operable for rotational movement of said active subsystem about a first axis perpendicular to a plane defined by said planar active subsystem;

a third, elevation subsystem coupled to said second, roll subsystem and to a fourth azimuth subsystem, said azimuth subsystem defining a central axis of the antenna system and being operable for providing rotational movement of the first planar subsystem about the central axis, the elevation subsystem being configured to provide a certain angular orientation between said plane defined by said active subsystem and a plane defined by the azimuth subsystem.

According to another embodiment, the present invention provides for an antenna system accommodating onto a platform for tracking a target moving relatively to the platform, comprising:

a first planar active subsystem operable for receiving/transmitting an RF signal of a certain linear polarization direction;

a second, roll subsystem coupled to said active subsystem and operable for rotational movement of said active subsystem about a first axis perpendicular to a plane defined by said planar active subsystem;

a third, elevation subsystem coupled to said second, roll subsystem and to a fourth azimuth subsystem, said azimuth subsystem defining a central axis of the antenna system and being operable for providing rotational movement of the first planar subsystem about the central axis, the elevation subsystem being configured to provide an adjustable angular orientation in a range of 0°–90° between said plane defined by said active subsystem and a plane defined by the azimuth subsystem, thereby allowing positioning said first planar active subsystem with respect to said target such that said linear polarization direction is substantially aligned with a linear polarization direction of RF radiation received and/or transmitted by the target.

According to yet another embodiment, the present invention provides for a method for tracking at least one target with an antenna system accommodating onto a platform moving relatively to the target, and having a planar active subsystem, the method comprising:

(i) receiving/transmitting an RF signal of a certain linear polarization direction;

(ii) receiving and storing data regarding the position and polarization of the target and the antenna system, constituting position and polarization data;

(iii) in response to said position and polarization data, having the active subsystem selectively performing azimuth rotational movement about a central axis of the antenna system, roll rotational movement about a first axis perpendicular to a plane defined by the planar active subsystem, and selectively adjusting the angular orientation in a range of 0°–90° between the plane defined by the active subsystem and the plane defined by the azimuth subsystem, thereby allowing positioning said planar active subsystem with respect to said target such that said linear polarization direction is aligned with a linear polarization direction of RF radiation received and/or transmitted by at least one target.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DESCRIPTION OF A SPECIFIC EMBODIMENT OF THE INVENTION

According to certain embodiments, the present invention provides for a planar antenna and preferably a phased array antenna system to be disposed onto a platform, and preferably a moving platform (e.g. airborne platform) for transmitting and/or receiving RF signal having linear polarization to and from at least one target moving relatively to the platform (e.g. geostationary satellite). The antenna system provides positioning capabilities as well as polarization tracking capabilities, thereby improving communication of RF signal having linear polarization between the platform and a target.

Figure 1:
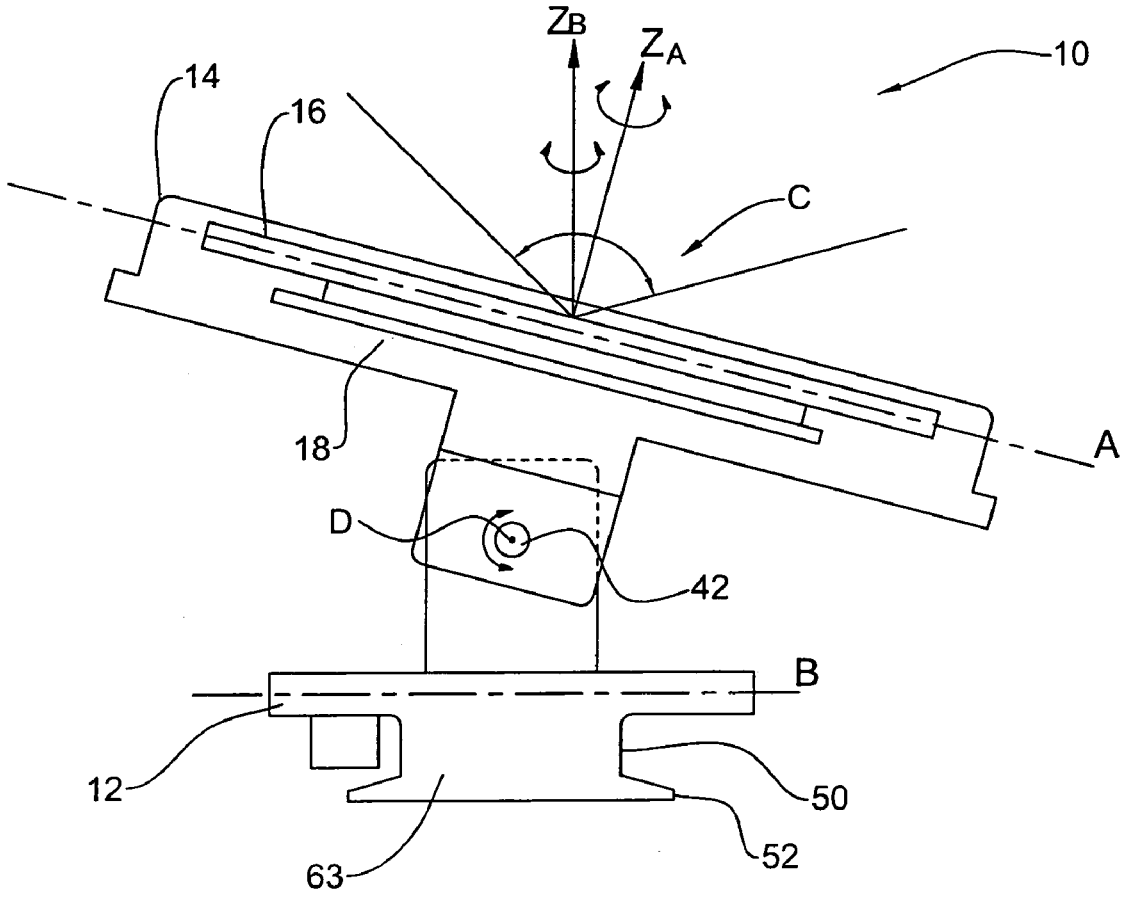
FIG. 1 is a general side view (in cross section) of an antenna system according to an embodiment of the invention.

FIG. 1 is a general side view (in cross section) of an antenna system 10 according to an embodiment of the invention. Antenna system 10 includes, inter-alia, an azimuth driving subsystem 12 defining a horizontal axis B and a $Z_B$ axis perpendicular thereto (constituting the central axis of the antenna system). Antenna system 10 further includes a tilt driving subsystem 14 defining an axis A and a $Z_A$ axis perpendicular thereto. Also shown is axis D, perpendicular to both B and $Z_B$. A substantially planar active subsystem 16 is coupled to the tilt driving subsystem 14, along axis A, and is operable to perform electronic scanning within cone C (preferably providing scanning angle of ±60°). Axis $Z_A$ represents the bore sight of the antenna. The active subsystem 16 is connected to a roll subsystem 18.

According to an embodiment of the present invention (shown in FIG. 1), antenna system 10 has four degrees of freedom, allowing it to selectively perform electronic scanning, azimuth, and roll movements, as well as tilt adjustment as required for positioning and polarization tracking, in the following manner:

electronic scanning within scan cone C.

the azimuth driving subsystem rotates the tilt driving subsystem 14 (and the active subsystem 16 accommodated thereon) around axis $Z_B$.

the tilt driving subsystem 14 rotates the active subsystem 16 around axis D, thereby tilting the active subsystem (axis A) with respect to axis B.

the roll subsystem rotates the active subsystem 16 around axis $Z_A$.

Figure 4:
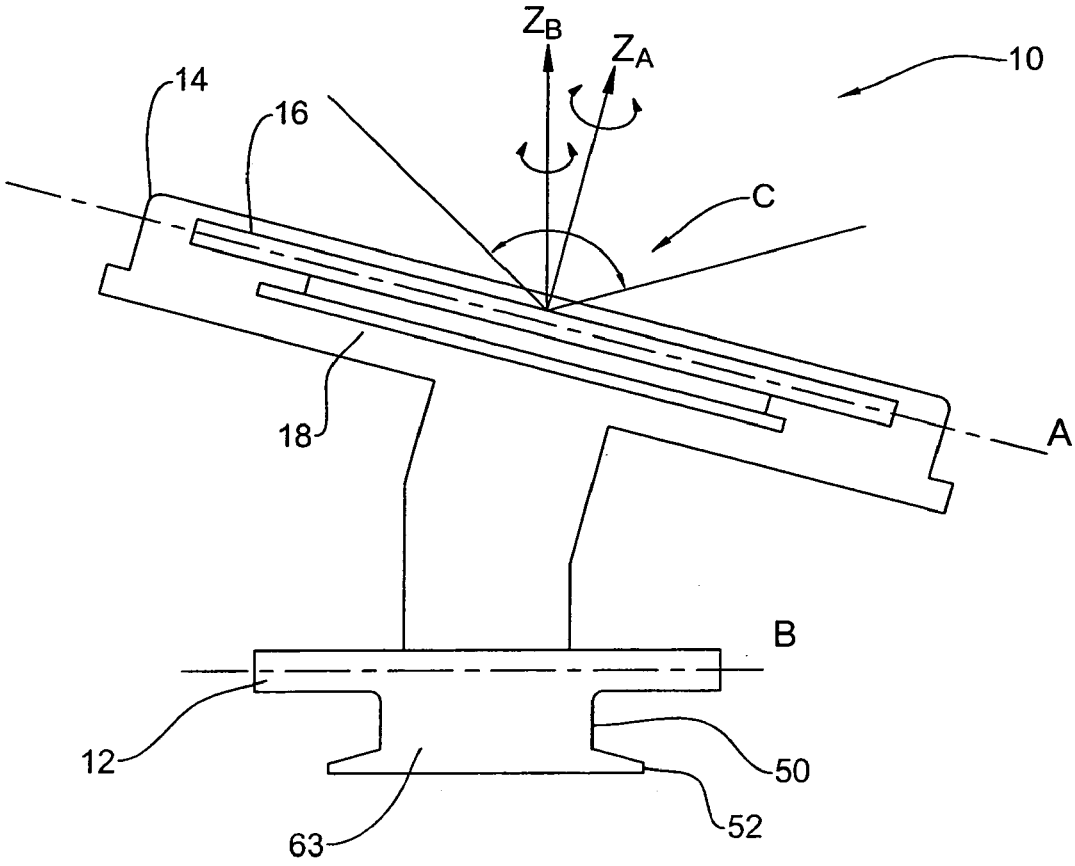
FIG. 4 is a general side view (in cross section) of an antenna according to another embodiment of the invention.

According to another embodiment of the invention, generally shown in FIG. 4, a fixed tilt is provided, e.g. an angle in the range of 20°–30° between axis B and axis A. According to this embodiment, positioning as well as polarization tracking are carried out based on movements in only three degrees of freedom, as follows:

electronic scanning within scan cone C.

the azimuth driving subsystem rotates the tilt driving subsystem 14 (and the active subsystem 16 accommodated thereon) around axis $Z_B$.

the roll subsystem rotates the active subsystem 16 around axis $Z_A$.

As will be detailed further on, all degrees of freedom are controlled by a common control system (not shown in FIGS. 1, 2 and 4) and operate in synchronization to provide positioning and polarization tracking. The selective nature of the dynamic operation of the various subsystems will be explained further on, with reference to FIG. 7.

Figure 2:
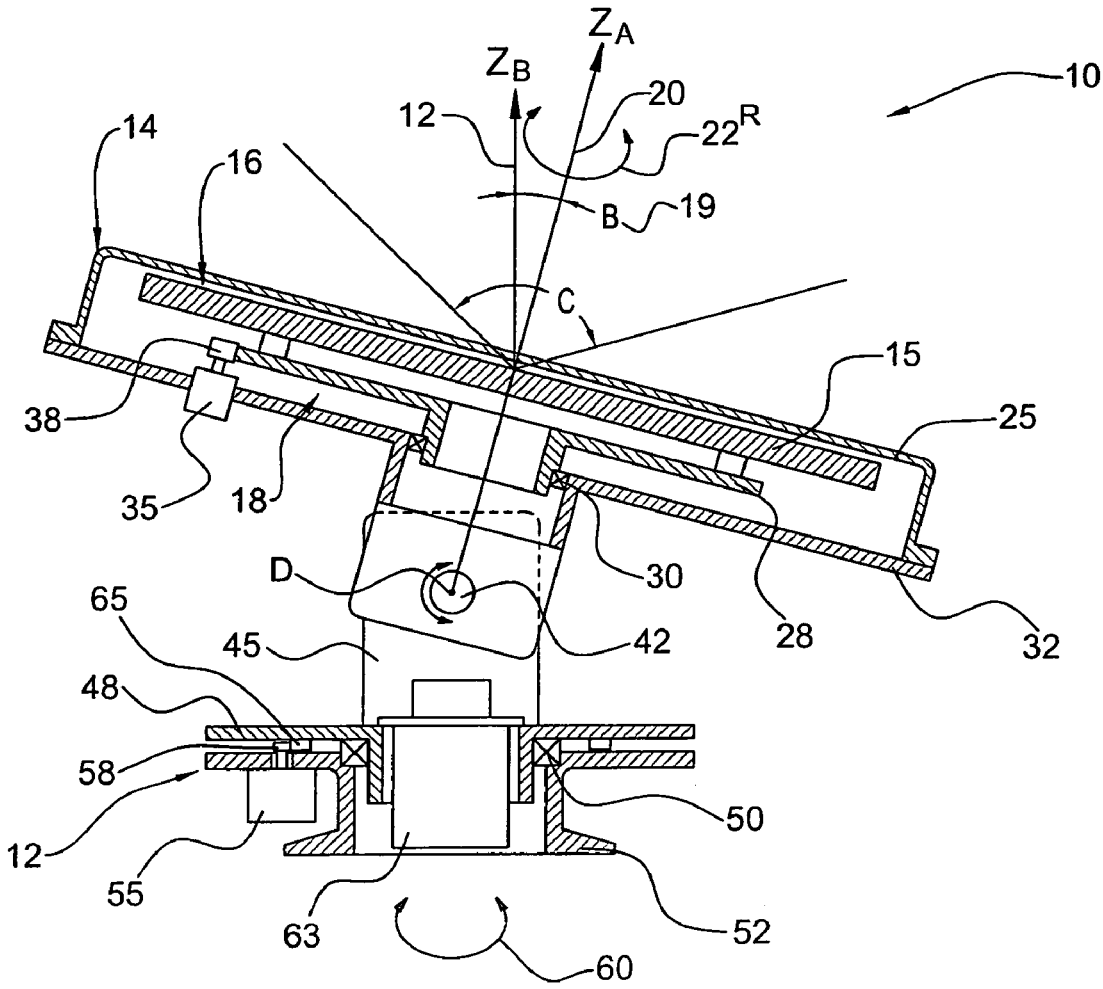
FIG. 2 is a more detailed side view (in cross section) of an antenna system according to an embodiment of the invention.
Figure 3:
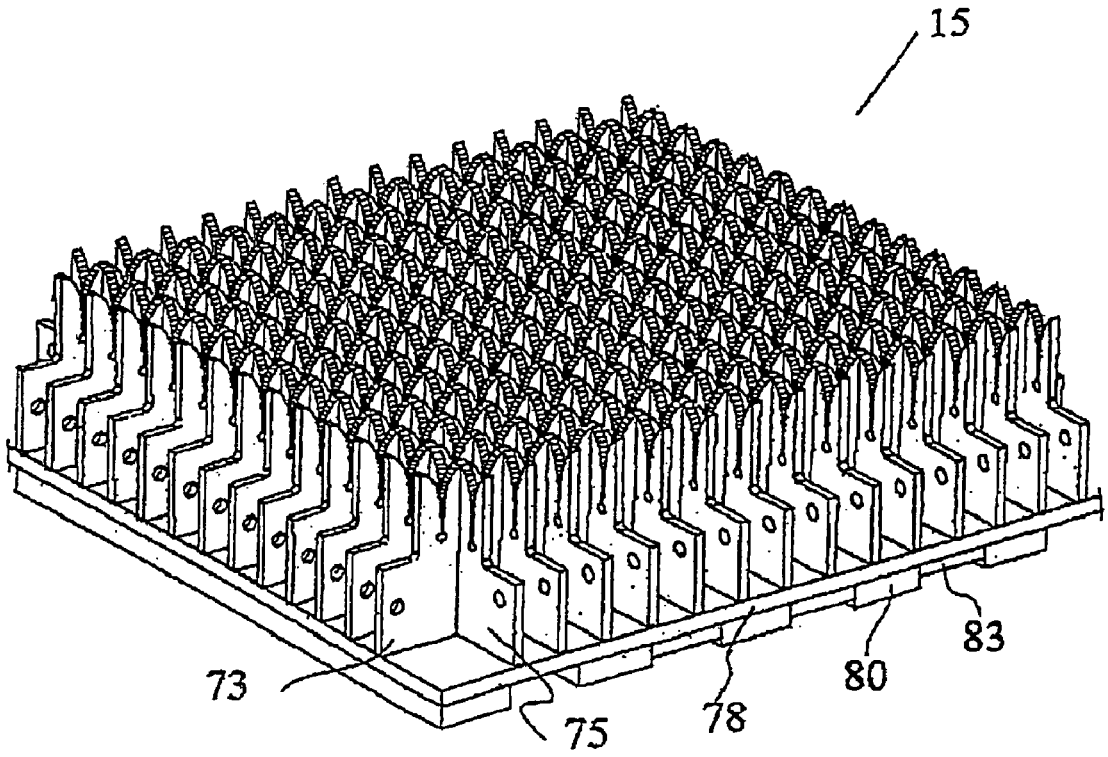
FIG. 3 is an isometric partial view of a part of an antenna according to an embodiment of the invention.

Turning back to the embodiment of the invention shown in FIG. 1: FIG. 2 is a more detailed side view (in cross section) of the antenna system 10 shown in FIG. 1. According to an embodiment of the invention, antenna system 10 incorporates an active subsystem 16 which comprises an electronically scanned, substantially planar phased array antenna 15, e.g. as shown in FIG. 3. Antenna 15 is constructed from two interleaved arrays of radiating elements 73 and 75, orthogonal to each other, having linear polarization, designed to transmit and receive RF radiation in different frequency bends, respectively. According to an embodiment of the invention, the radiating elements are the known wide-band Vivaldi antennas, which may be excited by a transmit module TX, receive module RX or a combination of TX and RX. (TX and RX modules are not shown in FIG. 3). As is known in the art, antenna 15 further comprises, inter alia, PCB 78, heat-sinks 80 and DC/DC converters 83. As is also known in the art, the two interleaved arrays 73 and 75, which have orthogonal linear polarization, are suitable for communication purposes since transmitted and received beams have different frequencies, thus do not interfere with each other. According to an embodiment of the invention, antenna 15 is designed for operating in the Ku-band, e.g. transmission (from aircraft to satellite) in the 14–14.5 GHz band, receiving (satellite to aircraft) in the 10.95–11.7 GHz band.

Turning back to FIG. 2: the active subsystem 16 further accommodates roll driving subsystem 18, comprising roll plate 28 to which the antenna 15 is connected. Roll plate 28 has a hollow shaft mounted on roll bearings 30 and is movable by roll motor 35 and pinion 38. Roll subsystem 18 is thus designed to provide roll movement (i.e. rotate around axis $Z_A$, as shown in FIG. 1), thereby allowing antenna 15 to keep matching its linear polarization to that of the tracked satellite. According to an embodiment of the invention, the roll movement is limited to ±180°. The Antenna 15 is fed via e.g. a rotary-joint slip-rings block (not shown), assembled in the hollow shaft, or by flexible cables (not shown).

As known in the art with respect to electronically scanned phased array antennas, better antenna performance is achieved by maintaining the elevation angle above the plane of the array above a certain value, typically about 30° or less. Therefore, according to one embodiment of the invention, a tilt angle of up to ±30°, is combined with an azimuth movement for yielding elevation coverage of ±90°, as follows.

Tilt subsystem 14 (shown in FIGS. 1 and 2) comprises a tilt base 32, to which is connected the radiating subsystem 16, via the roll subsystem 18. Tilt base 32 is movable around tilt axis D. e.g. by a motor-gear unit (not shown), coupled with a gear, (not shown), attached to tilt shaft 42. Tilt subsystem 14 is connected to the azimuth subsystem 12 by side plates 45 via tilt bearings (not shown).

Azimuth driving subsystem 12 (shown in both FIGS. 1 and 2) comprises azimuth turntable 48, rotatable around axis $Z_B$. According to an embodiment of the invention, azimuth turntable 48 has a hollow shaft, on which azimuth bearings 50 are installed. Azimuth bearings 50 are carried by pedestal base 52, which is used to install the antenna 10 onto the mounting base of the moving platform (e.g. an aircraft). Azimuth movement is achieved by azimuth motor 55 and azimuth pinion 58 meshed with azimuth gear 65. A rotary joint-slip rings block 63 is attached to the hollow shaft of the azimuth table 48, to allow conveying RF radiation and electricity.

The azimuth, tilt and roll driving subsystems (elements 12, 14 and 18) are coupled to and controlled by a control system (not shown in FIGS. 1 and 2). The common control system and its operation will be discussed further on with reference to FIGS. 5 to 7.

As is clear to a person versed in the art, digital, mechanical, or other servo components, as well as encoder components (not shown in FIG. 2) used for controlling the various movements, can readily be integrated in the system. It should be understood that the invention is not limited by the type and kind of drivers (motors, gears, etc.) used, and other driving components, such as pancake torque motors directly mounted onto the shafts, can be appropriately used without departing from the scope of the invention.

When used in aircrafts, the antenna system of the present invention can be implemented as a relatively small and low profile system (e.g. diameter of about 90 cm or less, height of about 40 cm or less). The system can be flatly mounted e.g. on the crown of the aircraft, thereby providing the aircraft with improved communication capabilities without harming the aerodynamic design of the aircraft.

Figure 5:
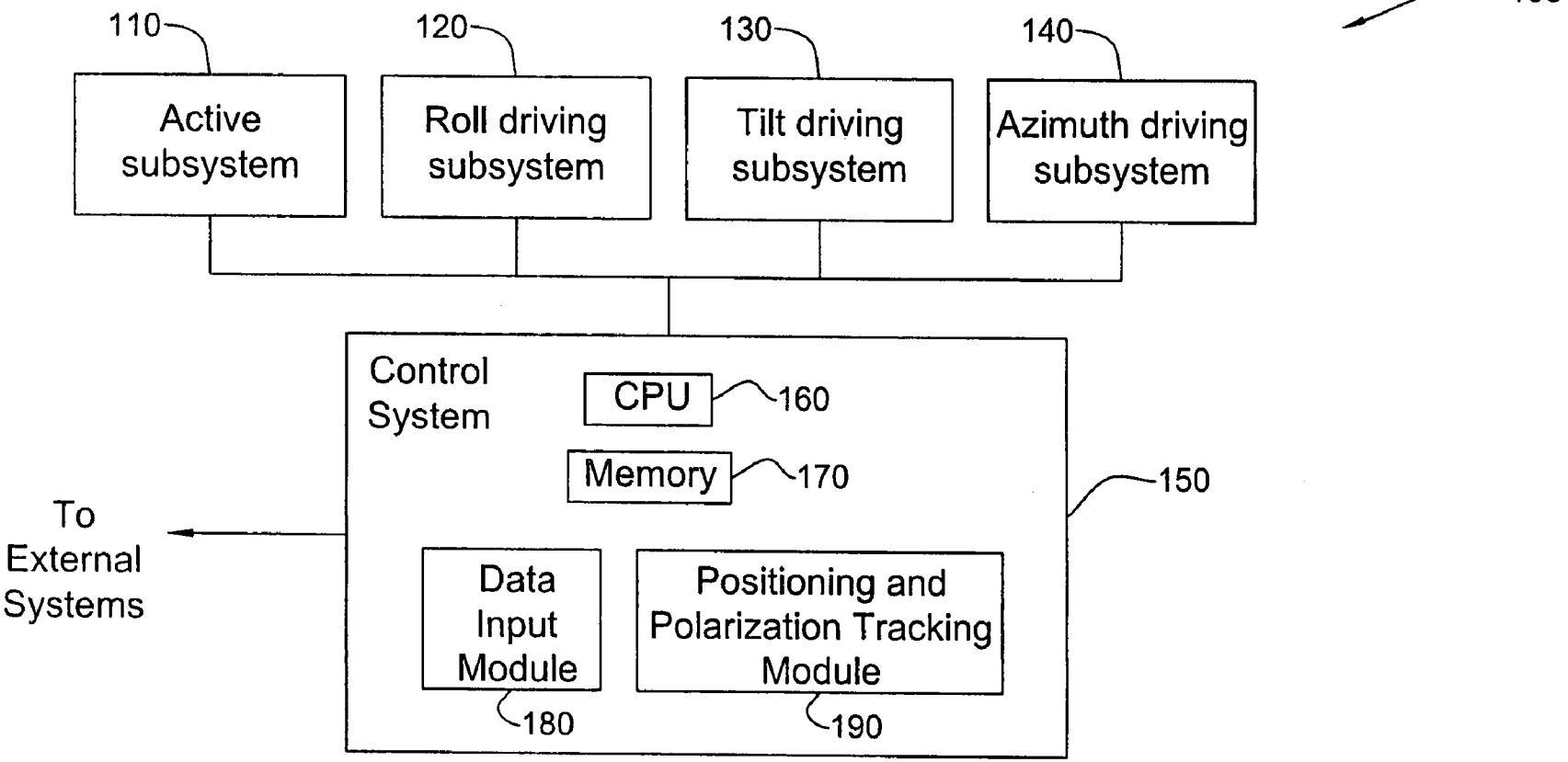
FIG. 5 is a general block diagram of an antenna system according to an embodiment of the invention.

Turning now to FIG. 5 there will follow a description of the common control system mentioned above. FIG. 5 is a block diagram of an antenna system 100 according to the embodiment of the invention shown in FIG. 1. As mentioned before, antenna system 100 is mounted on board a moving platform (e.g. an aircraft) and is used for communication with a moving target (e.g. a satellite). As shown the active subsystem 110, roll driving subsystem 120, tilt driving subsystem 130 and azimuth driving subsystem 140 are all coupled to a common control system 150. The control system 150 comprises, inter-alia, a central processing unit (CPU) 160 and a memory 170 coupled to the CPU.

Control system 150 is connectable to external systems not shown in FIG. 5 (e.g. data systems accommodated onto the moving platform (e.g. global positioning system (GPS), inertial navigation system (INS), localization system and the like) for receiving position data. Control system 150 accommodates a data input module 180 coupled to the CPU 160 and configured for providing position data relating to the relative position of the moving platform with respect to the moving target. Control system 150 further accommodates a positioning and polarization tracking module 190 coupled to the CPU 160 and configured for providing control signals for driving the active, roll, tilt and azimuth subsystems 110–140.

Figure 6A:
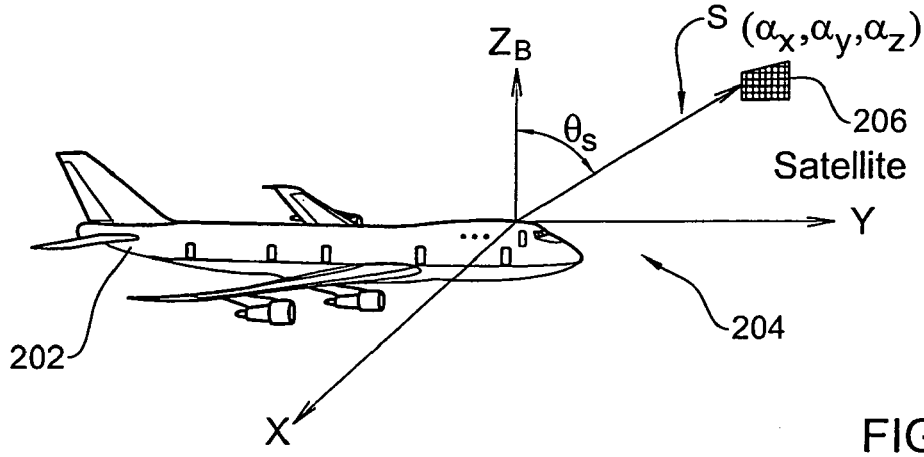
FIGS. 6*a*–6*c* illustrate the principles of positioning and polarization tracking according to an embodiment of the invention.

The principles of positioning and polarization tracking according to an embodiment of the invention will now be detailed with reference to an exemplary scene and exemplary control parameters shown in FIGS. 6*a*–6*c*. FIG. 6*a* shows the moving platform, aircraft 202 in this exemplary scene, and the aircraft's coordinate system 204 used for describing the movements of the antenna system according to an embodiment of the invention, in which X axis starches along the aircraft's wings; Y axis starches along the aircraft's body; and Z axis is perpendicular to X and Y. The antenna system is mounted on top of the aircraft 202 and therefore, with reference to FIGS. 1 and 3, Z axis shown in FIG. 6*a* is axis $Z_B$, the center axis of the antenna. The top of the scanning cone (element C shown in FIG. 1, not shown in FIG. 6*a*) located on the surface of the active subsystem (element 15 shown in FIG. 1) and along the center axis of the antenna is the origin O of the coordinate system 206. Also shown in FIG. 6*a* is a moving target, satellite 206 in this exemplary scene. The position of the satellite 206 is defined by its position vector S, represented by $\theta_S$ (the angle between S axis and Z axis), and the angular components $\alpha_X$, $\alpha_Y$ and $\alpha_Z$.

Figure 6B:
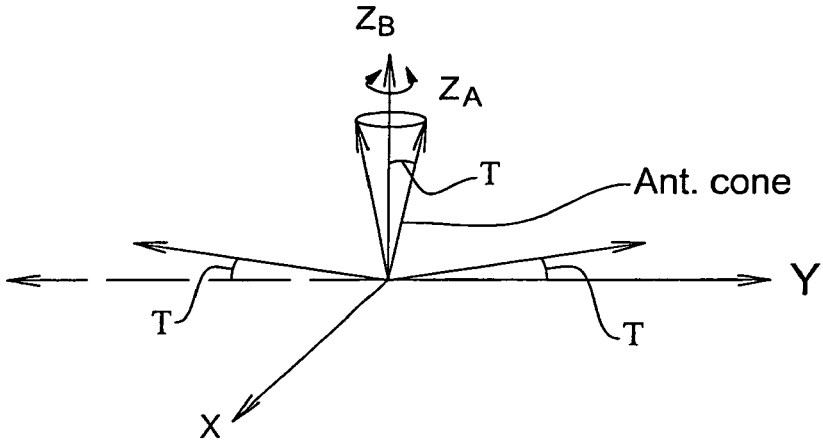

FIG. 6*b* illustrate the cone of broadside directions AC of the antenna system, resulting from a 360° rotation of the active subsystem (element 16 shown in FIG. 1) by the azimuth subsystem (element 12 shown in FIG. 1). In other words, the cone of broadside directions AC is the result of a 360° rotation of axis $Z_A$ about axis $Z_B$ (both shown in FIG. 1). The solid angle T of the cone AC equals to the angular orientation (the so-called 'tilt') between plains A and B (shown in FIG. 1), as detailed above with reference to FIGS. 1 and 3. Note that by one embodiment of the invention, T is changeable (e.g. as shown in FIG. 2). By another embodiment, T is fixed (e.g. as shown in FIG. 3).

Figure 6C:
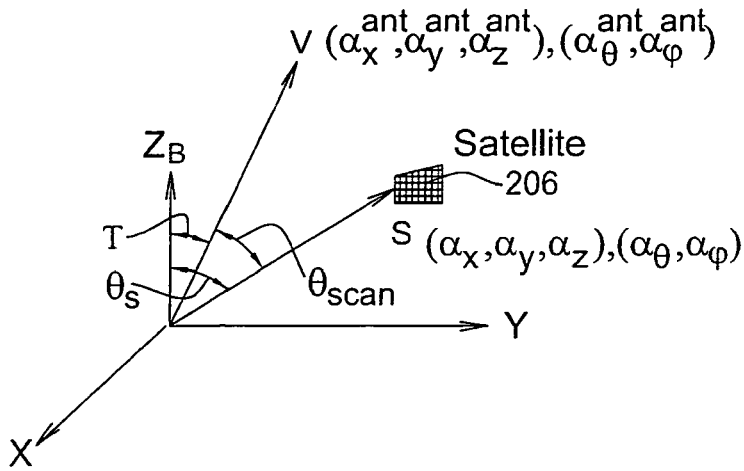

FIG. 6*c* illustrates an exemplary set of control parameters and a desired disposition of the antenna system mounted onboard the aircraft with respect to the satellite, in which the linear polarization direction of the antenna system is aligned with that of the satellite. There are shown:

$\theta_S$: the angle between S and the central axis of the antenna ($Z_B$);

T: the tilt angle of the broadside ($Z_A$) with respect to the central axis of the antenna ($Z_B$);

θscan: the solid angle of scanning cone C shown in FIG. 1;

S: the position vector of the satellite, represented by ($\alpha_x$, $\alpha_y$, $\alpha_z$), ($\alpha_\theta$, $\alpha_\phi$);

V: the broadside vector of the antenna (pointing along $Z_A$, the central axis of the antenna) represented by ($\alpha^{ant}{}_x$, $\alpha^{ant}{}_y$, $\alpha^{ant}{}_z$), ($\alpha^{ant}{}_\theta$, $\alpha^{ant}{}_\phi$);

According to one embodiment of the invention, in the desired disposition, V lays at $Z_B$-S plane. During the relative movement of the aircraft and the satellite, $\theta_S$ may vary from zero to 90°. In order to keep the linear polarization direction of the antenna aligned with that of the satellite, θscan is required to follow the following relations:

$$\theta scan \geqq \theta_S - T \text{ if } \theta_S > T, \text{ or} \quad (1)$$

$$\theta scan \leqq \theta_S - T \text{ if } \theta_S < T \quad (2)$$

In other words, in the desired disposition, S passes through the scanning cone C while substantially intersecting the cone top. According to another embodiment of the invention, in the desired position S substantially coincides with the center axis of the scanning cone to yield minimal scanning angle, up to zero (no scanning is required).

Figure 7:
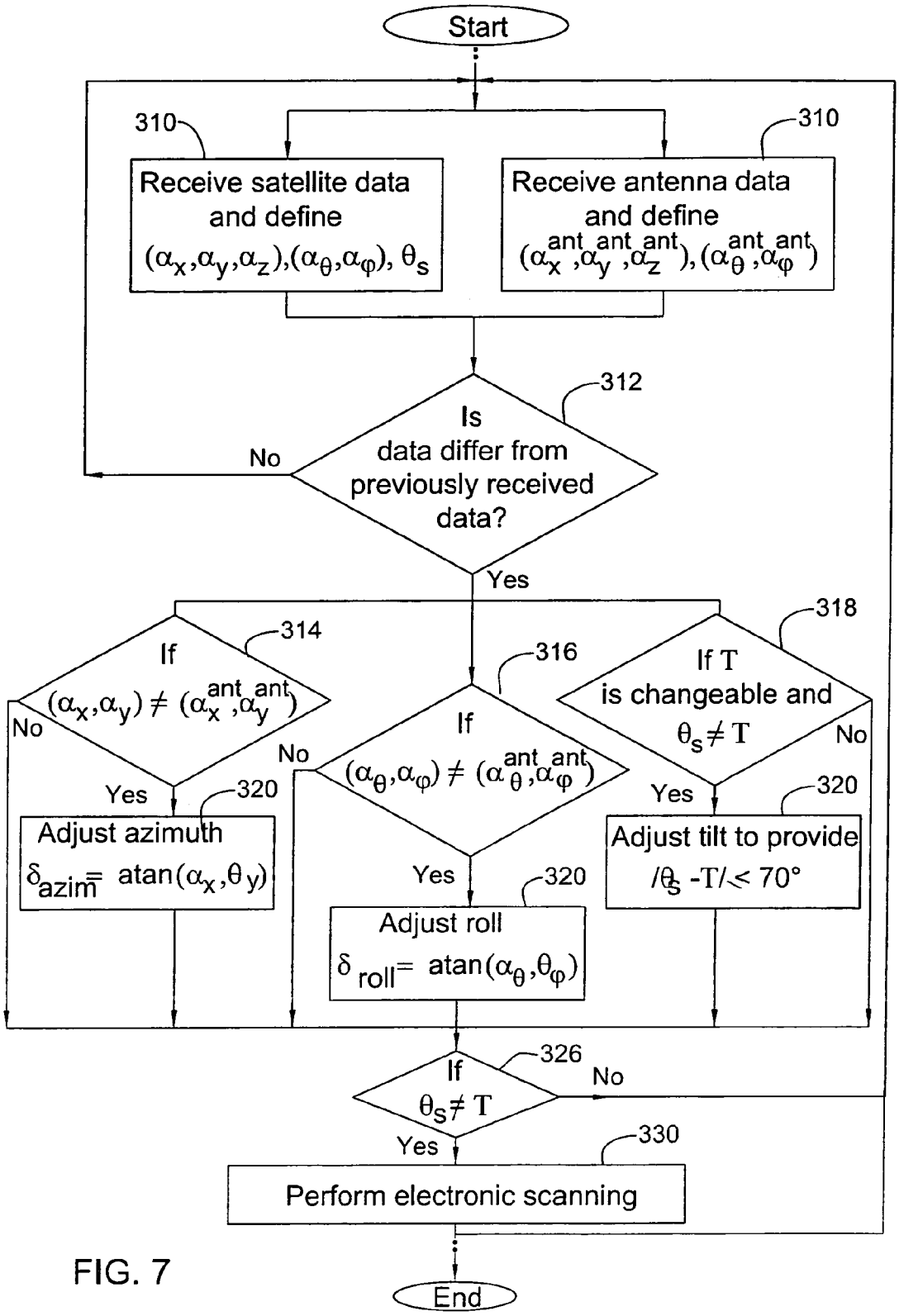
FIG. 7 is a flow chart showing a sequence of operations carried out by a control unit according to an embodiment of the invention.

In order to achieve the desired disposition of the antenna system with respect to the satellite, the following sequence of operations 300 shown in FIG. 7 is carried out by the common control unit in a cyclic manner (element 150 shown in FIG. 5) according to an embodiment of the invention:

In operation 310: receiving and storing the position and polarization of the satellite (e.g. using lookout tables), and the position and polarization of the antenna (e.g. using data received from the host aircraft's systems), constituting position and polarization data of the current cycle of operation. Note that the position and polarization data can be achieved from various sources, e.g. localizer of the moving target, GPS (Global Positioning System) system, INS (Inertial Navigation System) system, altitude system measuring the altitude of the moving platform, encoders measuring the changes in position of the azimuth, roll and tilt subsystem, and more. Note that the invention is not bound by the type of information, and the manner used for detecting the position and polarization of the satellite and the antenna and evaluating their relative disposition in a timely and therefore at any instance in which new position and polarization data is received, the need for azimuth, roll and if possible—tilt adjustments is evaluated.

The azimuth adjustment (carried out by e.g. the azimuth driving subsystem 12, shown in both FIGS. 1 and 2) is performed in order to rotate the broadside ($Z_B$) to the $Z_B$-S plain. Therefore, the required azimuth adjustment equals the change in the relative displacement of the aircraft and the satellite, when projected over the $Z_B$-S plain. According to an embodiment of the invention, the azimuth adjustment $\delta_{azimuth}$ is provided if $(\alpha_x, \alpha_y) \neq (\alpha^{ant}{}_x, \alpha^{ant}{}_y)$ and follows relation (3):

$$\delta_{azimuth} = a\tan(\alpha_y, \alpha_x) \quad (3)$$

The roll adjustment (carried out by the roll driving subsystem 18 shown in FIGS. 1 and 2) is performed in order to adjust the direction of polarization of the antenna according to changes in the direction of the polarization of the satellite. According to an embodiment of the invention, the roll adjustment $\delta_{roll}$ is provided if $(\alpha_\Theta, \alpha_\Phi) \neq (\alpha^{ant}{}_\Theta, \alpha^{ant}{}_\Phi)$ and follows relation (4):

$$\delta_{roll} = a\tan(\alpha_\Theta, \alpha_\Phi) \quad (4)$$

As described above with reference to FIG. 1, the angle T may be changed (by use of the driven subsystem 14 as shown in FIG. 1). In this embodiment, tilt adjustment can be performed in order to provide minimum scanning angle (preferably achieved at $\theta_S \cong T$). Therefore, the required tilt adjustment $\delta_{tilt}$ may provide a new tilt angle T such that minimum function $\min(\theta_S - T)$ will follow the relation:

$$0 \cong \min(\theta_S - T) \quad (5)$$

According to another embodiment, the tilt adjustment is defined as the minimum that is required such that $\theta_S - T$ is equal to or less than a predetermined value (e.g. in the range of 60°–70°). It should be appreciated that tilt adjustment may be required only if $\theta_S$ extends a predetermined value (e.g. in the range of 60°–70°). It should also be appreciated that other considerations for defining the required tilt adjustment may be applied, e.g. limiting the tilt angle to fall between 20°–30°, and more. Furthermore, the invention can be applied with a fixed tilt angle, as shown in FIG. 2, and in such an implementation, no dynamic tilt adjustment is provided at all.

In operation 330: if needed (checked in operation 326), perform electronic scanning. Note that no electronic scanning is required when the broadside of the antenna coincides with the satellite position vector S. in other words, electronic scanning is performed if $\theta_S \neq T$.

Referring now to FIG. 7 in combination with FIG. 5: according to an embodiment of the invention illustrated above, operation 310 is performed by the data input module (element 180), and operations 312–330 are carried out by the position and polarization tracking module (element 190).

It should be appreciated that the invention is not bound by the specific considerations exemplified herein with reference to FIG. 7 in order to illustrate one embodiment of the invention, and other considerations can apply, with the necessary modifications, without departing from the scope of the invention.

The present invention was described with relation to a transmit/receive antenna and RF radiation of a certain linear polarization. It should be appreciated that the present invention is equally concerned with transmit antenna or receive antenna, and RF radiation of non-linear polarization, with the appropriate modifications.

The invention was described mainly with reference to communication between an aircraft and a geostationary satellite. It should be noted that the invention is not limited by the type of moving platform onto which the antenna system is mounted, e.g. ships, land vehicles and more. Furthermore, the present invention was described in details with respect to communication of RF signal having linear polarization between a moving platform and a target. It should be appreciated that the concepts and principles of the invention can also be implemented for communication of RF signals having linear polarization between a fixed platform and a moving target or vice versa (moving platform and fixed target), or moving platform and moving target, with the appropriate modifications and alterations, without departing from the scope of the present invention.

It should also be appreciated that the present invention can be implemented by using only three degrees of freedom as follows (the following reference numbers refer to FIG. 1):

- an azimuth driving subsystem (element 12 in FIG. 1) that rotates the tilt driving subsystem (element 14 in FIG. 1) and the active subsystem (element 16) accommodated thereon around axis $Z_B$.
- a tilt driving subsystem 14 that rotates the active subsystem 16 around axis D, thereby tilting the active subsystem (axis A) with respect to axis B by a tilt angle T, wherein $0 \leqq T \leqq 90°$.
- a roll subsystem that rotates the active subsystem 16 around axis $Z_A$.

As described with reference to operation 320 shown in FIG. 7, by providing a tilt angle in the range of $0 \geqq T \geqq 90°$, the electronic scanning angle θs can be minimized, up to θs=0. In other words, by using dynamic adjustment of the tilt angle T, according to an embodiment of the present invention, it is possible to maintain position and polarization tracking without the need to perform electronic scanning. Preferably, this embodiment is useful for an antenna system for tracking moving targets, mounted onto fixed platforms, land vehicles, ships and more.

It should be appreciated that the antenna system according to the invention may be used as a radar, an electronic counter measures (ECM) system or as a communication antenna, such as two-way broadband data communication via satellites having linear polarization mode.

Those skilled in the art to which the present invention pertains, can appreciate that while the present invention has been described in terms of certain embodiments, the concept upon which this disclosures is based may readily be utilized as a basis for the designing of other systems, services and processes for carrying out the several purposes of the present invention.

It will also be understood that the system according to the invention may be a suitably programmed computer system. Likewise, the invention contemplates a computer program being readable by a computer for executing the method of the invention. The invention further contemplates a machine-readable memory tangibly embodying a program of instructions executable by the machine for executing the method of the invention.

Also, it is to be understood that the phraseology and terminology employed herein are for the purpose of description and should not be regarded as limiting.

It is important, therefore, that the scope of the invention is not construed as being limited by the illustrative embodiments and examples set forth herein. Other variations are possible within the scope of the present invention as defined in the appended claims and their equivalents.

The invention claimed is:

1. A phased array antenna system accommodating onto a platform for tracking a target moving relatively to the platform, comprising:

a first planar active subsystem operable for receiving/transmitting an RF signal of a certain linear polarization direction and for selectively performing electronic scanning;

a second, roll subsystem coupled to said active subsystem and operable for rotational movement of said active subsystem about a first axis perpendicular to a plane defined by said planar active subsystem;

a third, elevation subsystem coupled to said second, roll subsystem and to a fourth azimuth subsystem, said azimuth subsystem defining a central axis of the antenna system and being operable for providing rotational movement of the first planar subsystem about the central axis, the elevation subsystem being configured to provide a certain angular orientation between said plane defined by said active subsystem and a plane defined by the azimuth subsystem, thereby allowing positioning said first planar active subsystem with respect to said target such that said linear polarization direction is substantially aligned with a linear polarization direction of RF radiation received and/or transmitted by the target.

2. The phased array antenna system according to claim 1 wherein said first, second and fourth subsystems are coupled to a common control system configured to operate said first, second and fourth subsystems in synchronization.

3. The phased array antenna system according to claim 2 wherein said common control subsystem comprising:

a Central Processing Unit (CPU);

a memory coupled to the CPU;

a data input module coupled to said CPU and connectable to data systems of said platform, for inputting data relating to the relative position of said platform with respect to said target; and a positioning and polarization tracking module coupled to the CPU and configured for operating said first, second and fourth subsystems.

4. The antenna system according to claim 3 wherein said data input module is configured to receive, in a timely manner, at least one data item from: relative disposition of the platform and the target, location of the target, GPS (Global Positioning System) data, INS (Inertial Navigation System) data, altitude of the platform, position data of said second subsystem; position data of said third subsystem; position data of said fourth subsystem.

5. An antenna system according to claim 1 wherein said third, elevation subsystem being configured to provide a fixed angular orientation between said plane defined by said active subsystem and a plane defined by the azimuth subsystem.

6. An antenna system according to claim 1 wherein said first active subsystem is further configured for selectively performing the electronic scanning substantially within a predefined scanning cone coaxial with said first axis.

7. An antenna system according to claim 6 wherein said predefined scanning cone provides scanning angle of about ±70° about the bore sight of the active subsystem.

8. An antenna system according to claim 2 wherein said third, elevation subsystem being configured to provide a controllably changeable angular orientation between said plane defined by said active subsystem and a plane defined by the azimuth subsystem.

9. An antenna system according to claim 8 wherein said common control unit is further configured for controlling the operation of said third, elevation subsystem, thereby allowing selective adjustment of said scanning cone.

10. An antenna system according to claim 1 wherein said platform is an airborne platform.

11. An antenna system according to claim 1 wherein said target is a geostationary satellite.

12. An antenna system according to claim 2 wherein said common control unit is configured to operate said first, second and fourth subsystems, in synchronization by performing the following operations:

(i) receiving and storing data regarding the position and polarization of the target and the antenna system, constituting position and polarization data;

(ii) in response to said position and polarization data, providing said first, second and forth subsystems with control signals for having the first subsystem selectively performing azimuth rotational movement about the central axis, roll rotational movement about the first axis, and electronic scanning; and (iii) repeating said operations (i)–(ii) as many time as desired.

13. An antenna system according to claim 8 wherein said common control unit is configured to operate said first, second, third and fourth subsystems, in synchronization by performing the following operations:

(i) receiving and storing data regarding the position and polarization of the target and the antenna system, constituting position and polarization data;

(ii) in response to said position and polarization data, providing said first, second, third and forth subsystems with control signals for selectively adjusting the angular orientation between the plane defined by the active subsystem and the plane defined by the azimuth subsystem, and having the first subsystem selectively performing azimuth rotational movement about the central axis, roll rotational movement about the first axis, and electronic scanning; and (iii) repeating said operations (i)–(ii) as many time as desired.

14. A method for tracking at least one target with a phased array antenna system having a planar active subsystem and accommodating onto a platform moving relatively to the target, the method comprising:

(i) receiving/transmitting an RF signal of a certain linear polarization direction;

(ii) receiving and storing data regarding the position and polarization of the target and the antenna system, constituting position and polarization data;

(iii) in response to said position and polarization data, having the active subsystem selectively performing azimuth rotational movement about a central axis of the antenna system, roll rotational movement about a first axis perpendicular to a plane defined by the planar active subsystem, and electronic scanning;

thereby allowing positioning said planar active subsystem with respect to said target such that said linear polarization direction is aligned with a linear polarization direction of RF radiation received and/or transmitted by at least one moving target.

15. A method according to claim 14 further comprising, in response to said position and polarization data, selectively adjusting the angular orientation between the plane defined by the active subsystem and the plane defined by the azimuth subsystem.

16. A phased array antenna system accommodating onto a platform for tracking a target moving relatively to the platform comprising:

a first planar active subsystem operable for receiving/transmitting an RF signal of a certain linear polarization direction and for selectively performing electronic scanning;

a second, roll subsystem coupled to said active subsystem and operable for rotational movement of said active subsystem about a first axis perpendicular to a plane defined by said planar active subsystem;

a third, elevation subsystem coupled to said second, roll subsystem and to a fourth azimuth subsystem, said azimuth subsystem defining a central axis of the antenna system and being operable for providing rotational movement of the first planar subsystem about the central axis, the elevation subsystem being configured to provide a certain angular orientation between said plane defined by said active subsystem and a plane defined by the azimuth subsystem.

17. An antenna system accommodating onto a platform for tracking a target moving relatively to the platform, comprising:

a first planar active subsystem operable for receiving/transmitting an RF signal of a certain linear polarization direction;

a second, roll subsystem coupled to said active subsystem and operable for rotational movement of said active subsystem about a first axis perpendicular to a plane defined by said planar active subsystem;

a third, elevation subsystem coupled to said second, roll subsystem and to a fourth azimuth subsystem, said azimuth subsystem defining a central axis of the antenna system and being operable for providing rotational movement of the first planar subsystem about the central axis, the elevation subsystem being configured to provide an adjustable angular orientation in a range of 0°–90° between said plane defined by said active subsystem and a plane defined by the azimuth subsystem, thereby allowing positioning said first planar active subsystem with respect to said target such that said linear polarization direction is substantially aligned with a linear polarization direction of RF radiation received and/or transmitted by the target.

18. A method for tracking at least one target with an antenna system accommodating onto a platform moving relatively to the target, and having a planar active subsystem, the method comprising:

(i) receiving/transmitting an RF signal of a certain linear polarization direction;

(ii) receiving and storing data regarding the position and polarization of the target and the antenna system, constituting position and polarization data;

(iii) in response to said position and polarization data, having the active subsystem selectively performing azimuth rotational movement about a central axis of the antenna system, roll rotational movement about a first axis perpendicular to a plane defined by the planar active subsystem, and selectively adjusting the angular orientation in a range of 0°–90° between the plane defined by the active subsystem and the plane defined by the azimuth subsystem, thereby allowing positioning said planar active subsystem with respect to said target such that said linear polarization direction is aligned with a linear polarization direction of RF radiation received and/or transmitted by at least one target.

* * * * *

UNITED STATES PATENT AND TRADEMARK OFFICE

CERTIFICATE OF CORRECTION

PATENT NO. : 7,109,937 B2
APPLICATION NO. : 10/998155
DATED : September 19, 2006
INVENTOR(S) : Iluz et al.

It is certified that error appears in the above-identified patent and that said Letters Patent is hereby corrected as shown below:

On the cover page, item 54, and column 1, line 1, insert the term --AN IMPROVED-- before the word "PHASED".

Signed and Sealed this

Thirtieth Day of January, 2007

JON W. DUDAS
*Director of the United States Patent and Trademark Office*